US005974628A

United States Patent [19]

Giuliani

[11] Patent Number: 5,974,628

[45] Date of Patent: Nov. 2, 1999

[54] CARD FOR TEXTILE FIBERS WITH CARDING CYLINDERS COOPERATING IN SERIES

[76] Inventor: Marcello Giuliani, Via Cellerese No.33, 50013 Campi Bisenzio, Firenze, Italy

[21] Appl. No.: 08/816,264

[22] Filed: Mar. 13, 1997

[30] Foreign Application Priority Data

Mar. 25, 1996 [IT] Italy ..... FI96A0061

[51] Int. Cl.[6] ..... D01G 15/00

[52] U.S. Cl. ..... 19/98; 19/99; 19/102; 19/104; 19/112

[58] Field of Search ..... 19/98, 99, 102, 19/104, 110, 111, 112

[56] References Cited

U.S. PATENT DOCUMENTS

| | | | |
|---|---|---|---|
| 1,880,670 | 10/1932 | Bates | 19/99 |
| 2,014,673 | 9/1935 | Setzer | 19/112 |
| 2,044,460 | 6/1936 | Bartram et al. | 19/112 |
| 3,087,202 | 4/1963 | Varga | 19/99 |
| 3,097,399 | 7/1963 | Alston | 19/98 |
| 3,983,273 | 9/1976 | Elliott | 19/99 |
| 4,115,903 | 9/1978 | Barber | 19/99 |
| 4,219,908 | 9/1980 | Winch et al. | 19/104 |
| 4,523,350 | 6/1985 | Schmiedgen | 19/98 |
| 4,712,276 | 12/1987 | Krusche | 19/99 |
| 4,958,404 | 9/1990 | Lasenga | 19/98 |

FOREIGN PATENT DOCUMENTS

| | | | |
|---|---|---|---|
| 497745 | 9/1992 | European Pat. Off. | 19/104 |

*Primary Examiner*—William Stryjewski
*Attorney, Agent, or Firm*—Hopgood, Calimafde, Kalil & Judlowe

[57] ABSTRACT

A feed roller with clothing, the so-called taker-in (1A), feeds a first carding cylinder (3,) which presents it to a second carding cylinder (7) which rotates at greater speed than that of the first carding cylinder and which in turn presents the material to a third even faster carding cylinder (11), which in turn presents it to the doffer (13); the clothings (3A,7A, 11A) of the successive cylinders are gradually thicker-set and more inclined.

5 Claims, 2 Drawing Sheets

CARD FOR TEXTILE FIBERS WITH CARDING CYLINDERS COOPERATING IN SERIES

FIELD OF THE INVENTION

Cotton cards are currently made with a single large carding cylinder, a feed roller or "taker-in" and a stripper drum or "doffer". Having a single cylinder, this has to be clothed with clothing suitable for carrying out carding, and hence such clothing—which is definitive—has to be tightly packed and with the maximum of inclination. In order to be able to produce a large quantity of sliver, the cylinder has to have a peripheral speed of not less than 1500/2000 meters/minute; this high speed strips the "taker-in" of the not yet parallelized fibers, obliging them to begin carding at high speed; this causes breakage of the fibers and the fibers which do not undergo carding will be transferred imperfectly parallelized to the final doffer, thereby creating an unsatisfactory web.

The invention relates to a card which avoids breakages of the fed fibers, obtaining at output a web with fibers which are more parallel, and better mixing in the event of fibers which differ in type, color and length.

These and other objects and advantages will become clear from the following text.

SUMMARY OF THE INVENTION

A card for textile fibers, comprising a feed roller with clothing (taker-in) and a stripper drum (doffer) which presents the web of a web separator member, comprises as carding members—according to the invention—at least two mutually tangential and cooperating carding cylinders, one of which withdraws the material from the taker-in and presents it directly to the next carding cylinder, which rotates at greater speed and presents it to the doffer. In a practical embodiment, the card comprises three carding cylinders, a first of which withdraws the material from the taker-in and presents it to a second carding cylinder, which rotates at greater speed than that of the first carding cylinder and which in turn presents the material to a third even faster carding cylinder, which in turn presents it to the doffer.

Each cylinder cooperates with its own fixed or moving carding bars having continuous covering.

Each carding cylinder has its own surface clothing sparser and less inclined—with respect to the radial direction—than that of the next carding cylinder.

In practice the third carding cylinder can have peripheral speed of the order of 3 to 5 times and better from 3.5 to 4.5 times that of the first carding cylinder, whilst the second carding cylinder has a peripheral speed intermediate between that of the first carding cylinder and that of the third carding cylinder. The carding cylinders can have diameter of the order of 400–450 cm and peripheral speeds of between 500 meters/minute and 2000 meters/minute.

In the card in question, with two or three carding cylinders in series and cooperating the one with the next, the carding cylinders mutually rid themselves of the fibers. Hence the first cylinder will have a relatively low speed; this low speed of the cylinder is possible since the latter does not have to be unloaded by the doffer but has merely to hand over directly to the second cylinder. Moreover, the first cylinder can have a number of carding spikes per unit surface area which can be around a third of that of current cotton cards and an inclination of the spikes, with respect to the tangent to the cylinder, which is less than that of the clothings of the cylinder of current cotton cards. Thus the first cylinder—having low peripheral speed, a smaller density of spikes and smaller inclination of the spikes—is able to strip the taker-in gently and can begin carding at low speed, thereby avoiding causing breakages of the fibers and moreover making the fibers aligned for presentation to the next carding cylinder. The second carding cylinder, having a greater peripheral speed than that of the first carding cylinder, can strip the already partly parallelized fibers from the first cylinder; this second cylinder can be clothed with spikes which are more inclined than those of the first cylinder and with a greater number of carding spikes per unit surface area, but still less than the density of spikes of the clothing of a standard cotton cylinder, thereby making the fibers still more parallel and much more carded and clean, so as to deliver them to the third cylinder.

The third cylinder will have a peripheral speed even greater than that of the second cylinder, without there being breakage of the fibers stripped from the second cylinder (which has already parallelized and cleaned them); moreover, the number of carding spikes—per unit surface area—will be greater than that of the spikes of the second cylinder and the spikes can have greater inclination—with respect to the radial direction—than that of the spikes of the clothings used in the presently existing cards and a greater peripheral speed and hence higher production. On exit, the web will exhibit greater parallelization than that of the web of current cards. The increase in speed and the increase in the number of carding spikes on the final cylinder are possible through the parallelization obtained with the carding effected by the carding cylinder or cylinders operating in series and upstream of the said final cylinder. Thus the fibers withdrawn from the final cylinder—in this instance the third cylinder—suffer no breakages, even if the peripheral speed and the inclination of the spikes thereof are very great and the packing of the clothing very dense.

The two or three (or more) carding cylinders can cooperate with fixed carding bars or with moving carding bars, with bars of both types combined, and arranged in suitable positions, depending on the mutual position of the carding cylinders.

The invention will be better understood by following the description and the appended drawing, which shows a practical non-limiting example of the invention. In the drawing:

DESCRIPTION OF THE INVENTION

Figure 1:
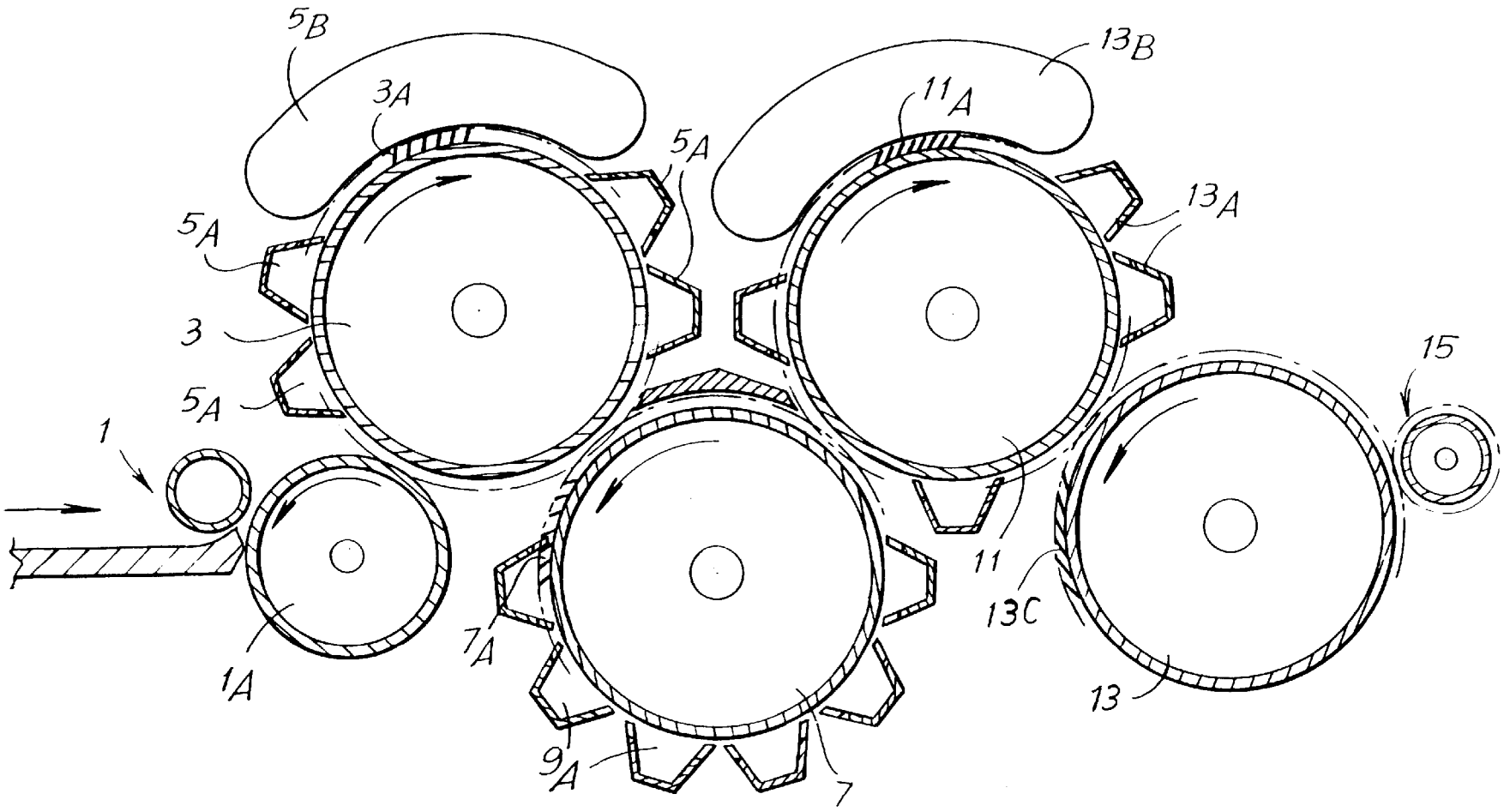
FIGS. 1 and 2 show two mutually equivalent diagrams of a card with three carding cylinders.

According to what is illustrated in FIG. 1, the numeral 1 indicates a feed set of which a feed roller or so-called taker-in 1A forms part. The numeral 3 depicts a first carding cylinder whose clothing 3A is tangential to the clothing of the taker-in 1A, so that the said first carding cylinder 3 strips the taker-in of the said material. Provided around the carding cylinder 3 are carding combs or carding bars, which can be of the fixed type as indicated with the label 5A and/or of the moving continuous-belt type as indicated by the numeral 5B.

The numeral 7 indicates a second intermediate carding cylinder whose clothing 7A is tangential to the clothing 3A of the carding cylinder 3 so as to strip the latter clothing of the partially carded material; the peripheral speed of the carding cylinder 7 is therefore greater than that of the carding cylinder 3. Carding bars or carding combs 9A, which can be of the fixed type and/or also of the moving type such as 5B, cooperate with the clothing 7A of the carding cylinder 7.

The numeral 11 indicates a third carding cylinder, whose clothing 11A is tangential and cooperating with the clothing 7A of the second carding cylinder 7, so as to be able to strip the clothing 7A and load up with the material worked by the cylinder 7. The carding cylinder 11 also cooperates with fixed 13A and/or moving 13B carding bars.

To enable subsequent handover of the material from the taker-in 1A to the carding cylinder 3, from the carding cylinder 3 to the carding cylinder 7 and from the carding cylinder 7 to the carding cylinder 11, the peripheral speeds of these members 1A, 3, 7, 11 are increasing. For example, the carding cylinder 3 can have a tangential speed of the order of 500 meters/minute, the carding cylinder 7 a speed of around 1300 meters/minute and the carding cylinder 11 a speed of up to the order of 2000 meters/minute. The diameter of the carding cylinders can be on average of the order of from 400 to 500 mm, hence of a size markedly smaller than that of the large cylinder of a conventional card. This notwithstanding, the clothings working in series of the three cylinders have relative speeds which are somewhat limited and hence always such as to minimize the distress to the fibers of the material to be carded, yet culminating in treatments which are satisfactory on account of the high speed of the last of the cylinders such as 11.

The numeral 13 indicates a stripper drum or so-called doffer, which with its own clothing 13A unloads, i.e. strips the clothing 11A of the carded material, so as to deliver this material to a web separator unit 15 which may employ rotating combs or reciprocating combs or the like and which is suitable for detaching the web to be directed to the conventional divider for forming the rovings or for other operations.

The direction of rotation of the carding cylinders 3, 7, 11, of the taker-in 1A and of the doffer 13 are indicated by the corresponding arrows. The peripheral speed of the doffer 13 will be greater than that of the third carding cylinder 11 so as to allow the stripping of the clothing 11A of the latter.

Figure 2:
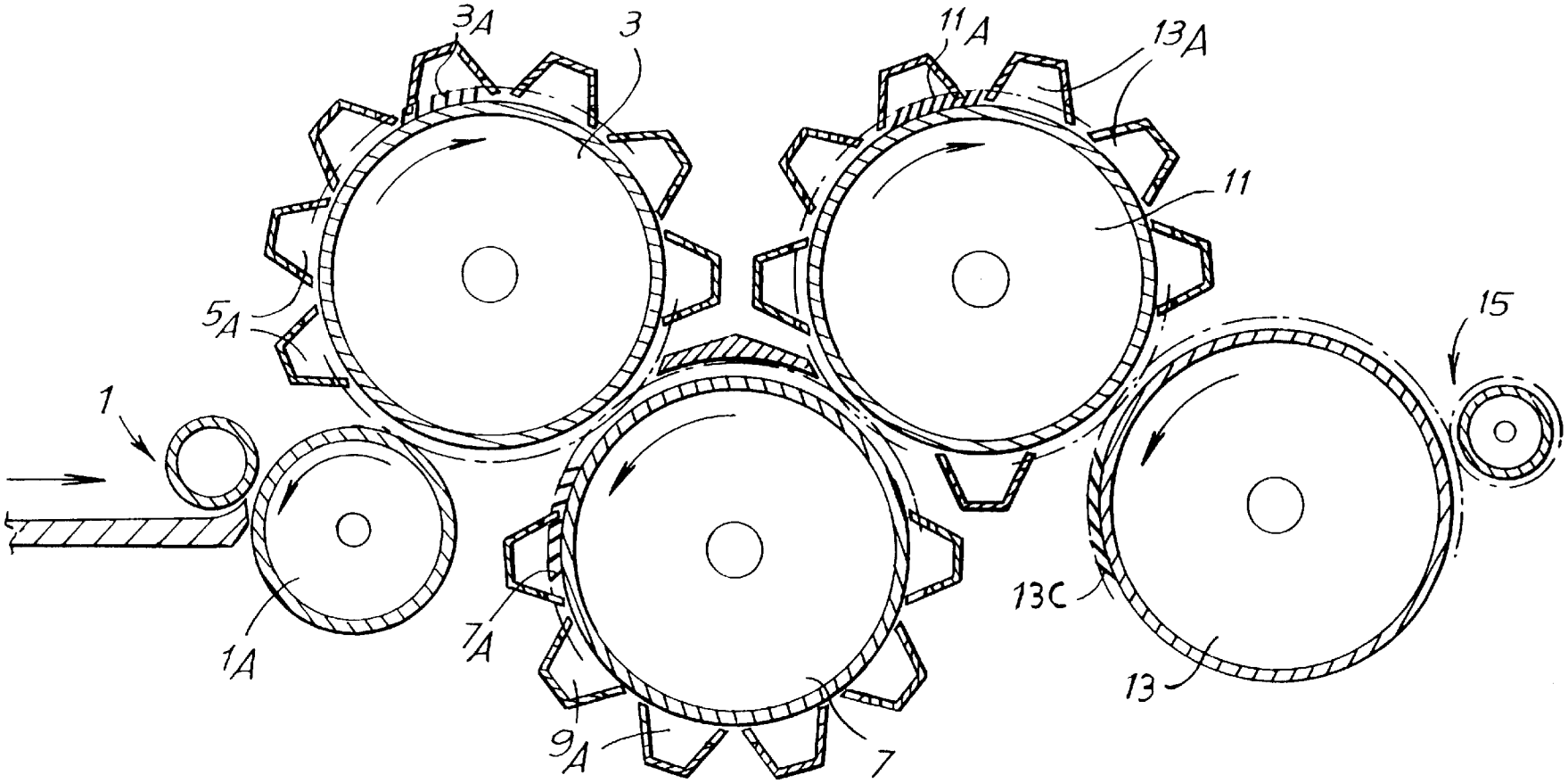

Indicated in FIG. 2 is an arrangement entirely equivalent to that described with reference to FIG. 1 with the members labeled with the same references as used for the description of FIG. 1. The only difference between the solution of FIG. 2 and that of FIG. 1 is that the three carding cylinders 3, 7, 11 are furnished only with fixed carding bars 5A, 9A and 13A.

It is understood that the drawing shows merely one example given solely by way of practical demonstration of the invention, it being possible for this invention to vary in its forms and arrangements without however departing from the scope of the concept underlying the invention.

I claim:

1. A card for producing a web of textile fibers consisting of a taker in feed roller (1A) which feeds a series of first, second and third cooperating carding cylinders (3, 7, 11), which also cooperate with fixed or revolving carding bars or carding combs (5A, 9A, 13A), and a stripper or doffer drum (13) which presents the web to web separator (15). said card characterized in that said cylinders (3, 7, 11) mutually tangentially arranged to cooperate one with the other, such that said first cylinder (3) withdraws the web material from said taker-in feed roller (1A) and presents it to said second carding cylinder (7) which then presents the web to said third carding cylinder (11) and from there to said stripper drum (13) wherein said second carding cylinder (7) rotates at a greater speed than said first carding cylinder (3) and said third carding cylinder (11) rotates at a greater speed than said second carding cylinder (7).

2. The card for textile fibers as in claim 1, wherein each of said carding cylinder has a surface clothing sparser and less inclined than that of the next succeeding carding cylinder.

3. The carding cylinders as in claim 2, wherein said carding cylinders have a diameter of the order of about 400 to 500 cm and peripheral speeds of between about 500 meters/minute and 2000 meters/minute.

4. The card for textile fibers, as in claim 1, wherein said carding cylinder (11) has a peripheral speed of the order of about 3 to 5 times greater than that of the first carding cylinder (3), wherein said second carding cylinder (7) has a peripheral speed intermediate said first carding cylinder (3) and said third carding cylinder (11).

5. The carding cylinder as in claim 4, wherein the peripheral speed of carding cylinder (11) is 3.5 to 4.5 times greater than that of carding cylinder (3).

* * * * *